US009816195B2

(12) United States Patent
Takahashi et al.

(10) Patent No.: US 9,816,195 B2
(45) Date of Patent: Nov. 14, 2017

(54) REPRODUCTION METHOD OF LIQUID EJECTING HEAD

(71) Applicant: CANON KABUSHIKI KAISHA, Tokyo (JP)

(72) Inventors: Kenji Takahashi, Yokohama (JP); Ichiro Saito, Yokohama (JP); Sadayoshi Sakuma, Yokohama (JP); Yuzuru Ishida, Yokohama (JP); Maki Kato, Fuchu (JP); Norihiro Yoshinari, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 682 days.

(21) Appl. No.: 14/261,119

(22) Filed: Apr. 24, 2014

(65) Prior Publication Data

US 2014/0318976 A1 Oct. 30, 2014

(30) Foreign Application Priority Data

Apr. 25, 2013 (JP) ..... 2013-093094

(51) Int. Cl.

| | |
|---|---|
| ***C25D 7/00*** | (2006.01) |
| ***B41J 2/14*** | (2006.01) |
| ***B41J 2/16*** | (2006.01) |

(52) U.S. Cl.

CPC ..... *C25D 7/00* (2013.01); *B41J 2/14129* (2013.01); *B41J 2/1603* (2013.01); *B41J 2/164* (2013.01); *B41J 2/1625* (2013.01)

(58) Field of Classification Search

CPC .... B41J 2/14129; B41J 2/1603; B41J 2/1625; B41J 2/164; C25D 7/00

See application file for complete search history.

(56) References Cited

U.S. PATENT DOCUMENTS

2006/0055744 A1* 3/2006 Tanaka ..... B41J 2/14233 347/70
2007/0262341 A1* 11/2007 Liu ..... H01L 33/62 257/103

FOREIGN PATENT DOCUMENTS

JP 09029984 * 2/1997 ..... B41J 2/165
JP 2002-113870 A 4/2002

* cited by examiner

*Primary Examiner* — Stefanie S Wittenberg
(74) *Attorney, Agent, or Firm* — Canon U.S.A., Inc. IP Division

(57) ABSTRACT

A reproduction method of a liquid ejecting head including: a process of filling the flow path with an electrolyte solution containing metal, and filling a space between an electrode capable of applying a voltage to between itself and the upper protective film and the upper protective film with the electrolyte solution; and a process of applying a voltage to between the upper protective film and the electrode to make the metal contained in the electrolyte solution deposit on the surface of the upper protective film.

8 Claims, 8 Drawing Sheets

REPRODUCTION METHOD OF LIQUID EJECTING HEAD

BACKGROUND OF THE INVENTION

Field of the Invention

The present invention relates to a reproduction method of a liquid ejecting head.

Description of the Related Art

An inkjet head, which is a typical liquid ejecting head, includes a plurality of ejection ports through which ink (a liquid) is ejected, flow paths communicating with the ejection ports, and an electrothermal converting element (a thermal energy generating element) which generates thermal energy used for the ejection of the ink. The electrothermal converting element consists of a heating resistor layer and an electrode which supplies the heating resistor layer with electric power. Since the electrothermal converting element is covered with an insulating protective layer having electrical insulation characteristics, insulation between the ink and the electrothermal converting element is ensured. The electrothermal converting element generates thermal energy when driven, the ink is heated rapidly in an area in which the electrothermal converting element is in contact with the ink (i.e., a thermal action portion) located above the electrothermal converting element, air bubbles form, and then the ink is ejected. In this manner, recording may be performed on a recording medium.

At this time, the thermal action portion of the inkjet head undergoes physical actions, such as impacts by formation of air bubbles and by cavitation due to shrinkage, and chemical actions by the ink. Japanese Patent Laid-Open No. 2002-113870 discloses a configuration in which a Ta film is provided in a thermal action portion which corresponds to an electrothermal converting element as an upper protective layer to protect the electrothermal converting element from these influences.

SUMMARY OF THE INVENTION

A reproduction method of a liquid ejecting head according to the present invention is a reproduction method of a liquid ejecting head which includes a liquid ejection head substrate including a thermal energy generating element configured to generate thermal energy for the ejection of a liquid, an insulating protective layer configured to cover the thermal energy generating element, and an upper protective film provided in the insulating protective layer at a position corresponding to the thermal energy generating element and including a surface in contact with the liquid, and a flow path member configured to form, between itself and the liquid ejection head substrate, a flow path through which the liquid to be ejected is supplied on the surface of the upper protective film, the method including: a process of filling the flow path with an electrolyte solution containing metal, and filling a space between an electrode capable of applying a voltage to between itself and the upper protective film and the upper protective film with the electrolyte solution; and a process of applying a voltage to between the upper protective film and the electrode to make the metal contained in the electrolyte solution deposit on the surface of the upper protective film.

Further features of the present invention will become apparent from the following description of exemplary embodiments with reference to the attached drawings.

DESCRIPTION OF THE EMBODIMENTS

If a liquid is repeatedly ejected for a prolonged period of time in a liquid ejecting head as that described in Japanese Patent Laid-Open No. 2002-113870, an upper protective layer is exposed to high temperature and undergoes physical actions, such as impacts by formation of air bubbles and by cavitation due to shrinkage, and chemical actions by the liquid. These complex influences may cause reduction in thickness of the upper protective layer.

If the thickness of the upper protective layer is reduced, heat is more easily transmitted from the electrothermal converting element to a surface of the upper protective layer. Therefore, there is a possibility that refoaming may occur in a liquid supplied after the liquid is ejected. In addition, since the temperature of the upper protective layer becomes higher, there is a possibility that the surface is rapidly oxidized. Further, there has been a problem that, if the thickness of the upper protective layer is reduced unevenly, foaming for the ejection of the liquid becomes unstable.

The present invention suppresses unstable liquid ejection due to reduced thickness of the upper protective layer and ensures high quality recording for a prolonged period of time.

Hereinafter, the present invention will be described in detail with reference to the drawings.

Liquid Ejection Head Substrate and Liquid Ejection Head

Figure 1:
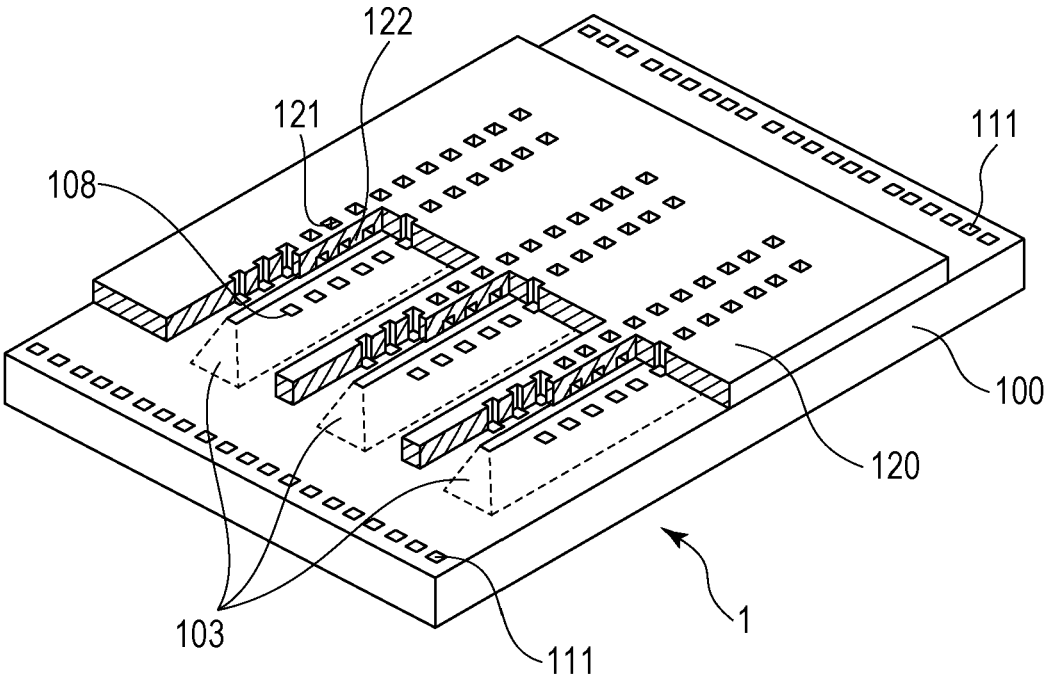
FIG. 1 is a perspective view illustrating an inkjet head according to an embodiment of the present invention.
Figure 2:
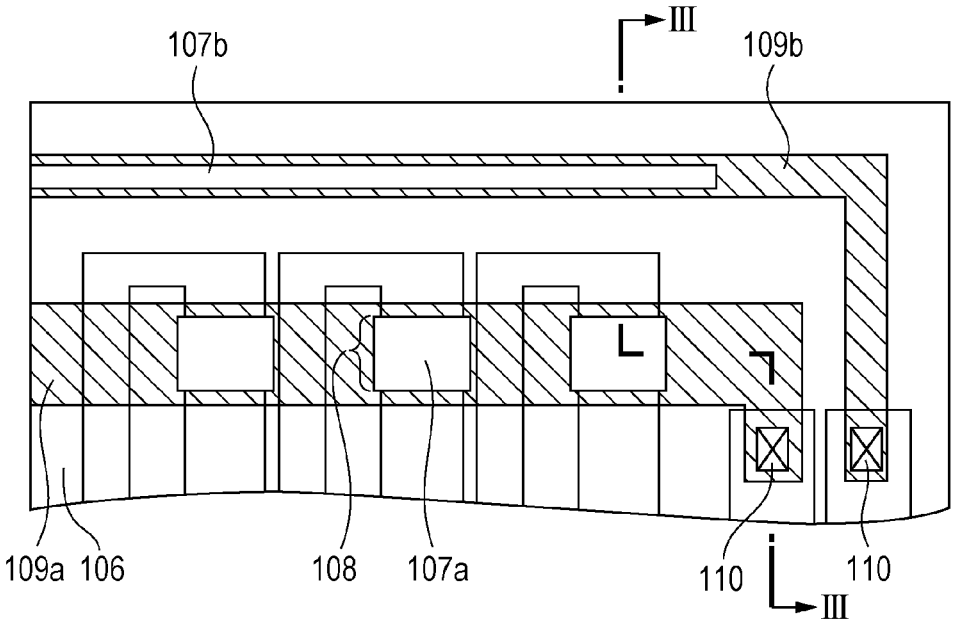
FIG. 2 is a schematic plan view illustrating an area near a heating unit of a liquid ejecting head substrate according to an embodiment of the present invention.
Figure 3:
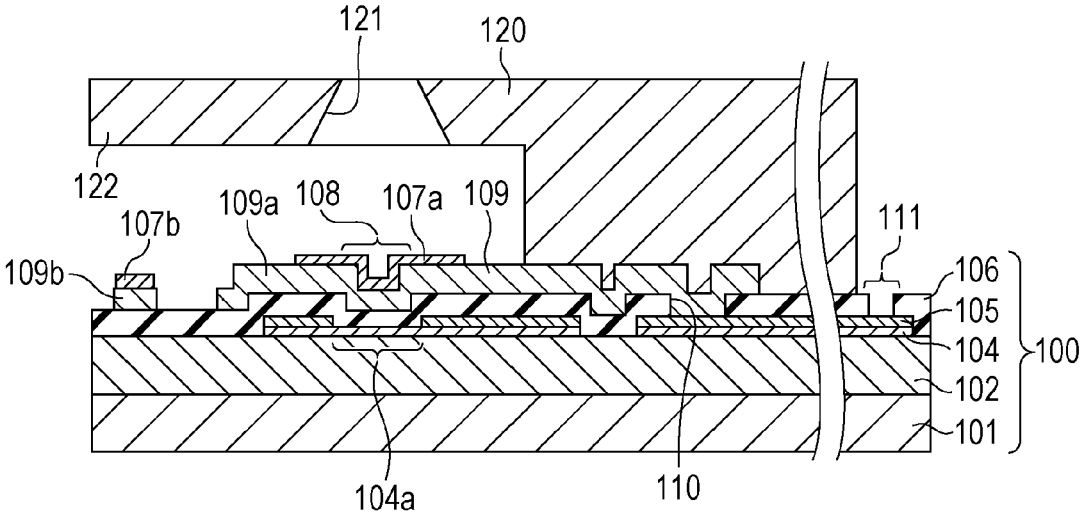
FIG. 3 is a schematic cross-sectional view illustrating an inkjet head according to an embodiment of the present invention.

FIG. 1 is a perspective view illustrating an inkjet head 1 as a liquid ejecting head according to an embodiment of the present invention. FIG. 2 is a schematic plan view of an area near a thermal action portion 108 of an inkjet head substrate 100 as a liquid ejecting head substrate according to an embodiment of the present invention. FIG. 3 is a schematic cross-sectional view illustrating the inkjet head 1 taken the substrate vertically along line III-III of FIG. 2.

As illustrated in FIG. 3, the inkjet head substrate 100 includes a silicon base 101, a heat accumulation layer 102 on the base 101, and a heating resistor layer 104 on the heat accumulation layer 102. The heat accumulation layer 102 is made of, for example, a thermally oxidized film, an SiO film and an SiN film. The heating resistor layer 104 is made of, for example, TaSiN. The inkjet head substrate 100 includes an electrode wiring layer 105 made of a metallic material, such as Al, Al—Si and Al—Cu, on the heating resistor layer 104. The electrode wiring layer 105 is partially removed and a pair of electrodes is formed at the removed part. The heating resistor layer 104 is exposed at a portion between the pair of electrodes. This portion forms a heating portion 104*a* as an electrothermal converting element (a thermal energy generating element) which generates thermal energy for the ejection of ink.

A lower protective layer 106 is provided on the electrode wiring layer 105 and the heating resistor layer 104 which is exposed from the pair of electrodes. The lower protective layer 106 is made of, for example, an SiO film and an SiN film, and functions also as an insulating protective layer. The electrode wiring layer 105 is connected to a driving element circuit or an external power supply terminal to receive external power supply. As an alternative configuration, the heating resistor layer 104 may be formed on the electrode wiring layer 105.

The reference numeral 107*a* denotes an upper protective layer (an upper protective film) provided above the lower protective layer 106. The upper protective layer 107*a* is for protecting the heating portion 104*a* from chemical and physical actions when the heating portion 104*a* is heated. The upper protective layer 107*a* is made of a metallic material which includes at least one of, for example, Ir, Ru, Pd and Pt. A portion of the upper protective layer 107*a* located above the heating portion 104*a* functions as the thermal action portion 108 (a thermal action surface) which is in contact with the ink and applies thermal energy to the ink.

An intermediate layer 109*a* is provided between the lower protective layer 106 and the upper protective layer 107*a*. The intermediate layer 109*a* forms a wiring section which electrically connects electrode terminals 111 used for the electrical connection between the upper protective layer 107*a* and the outside. The intermediate layer 109*a* is made of a conductive material. Specifically, the upper protective layer 107*a* is electrically connected to the electrode wiring layer 105 via through holes 110 formed in the intermediate layer 109*a* and the lower protective layer 106. The electrode wiring layer 105 is extended to an end portion of the inkjet head substrate 100 and is exposed from the lower protective layer 106 to form the electrode terminals 111. In the present embodiment, the intermediate layer 109*a* is made of a Ta film and has an effect of improving adhesiveness between the lower protective layer 106 and the upper protective layer 107*a*.

In a flow path, an electrode 107*b* which is formed in the same film forming process as that of the upper protective layer 107*a* and is connected to the electrode terminals 111 that are different from those connected to the upper protective layer 107*a* is provided. That is, the electrode 107*b* may apply the voltage to between the electrode 107*b* and the upper protective layer 107*a* via different electrode terminals 111. An intermediate layer 109*b* formed in the same film forming process as that of the intermediate layer 109*a* is provided between the electrode 107*b* and the lower protective layer 106.

As illustrated in FIGS. 1 and 3, a flow path member 120 is provided above the inkjet head substrate 100. With this configuration, the inkjet head 1 is formed. Ejection ports 121 through which the ink is ejected are formed in the flow path member 120. Each of the ejection ports 121 and each of the thermal action portions 108 are arranged to correspond to each other in the inkjet head 1.

A flow path wall 122 which forms the flow path is provided in the flow path member 120 and the flow path is formed between the inkjet head substrate 100 and the flow path member 120. Supply ports 103 through which the ink is supplied are formed in the inkjet head substrate 100. Arrays of the thermal action portions 108 are formed on both sides of each of the supply ports 103.

The ink supplied from the supply port 103 is supplied on the thermal action portion 108 through the flow path, air bubbles form in the ink with heat applied by the thermal action portion 108 and the ink is ejected through the ejection port 121.

Liquid Ejecting Apparatus

Figure 4:
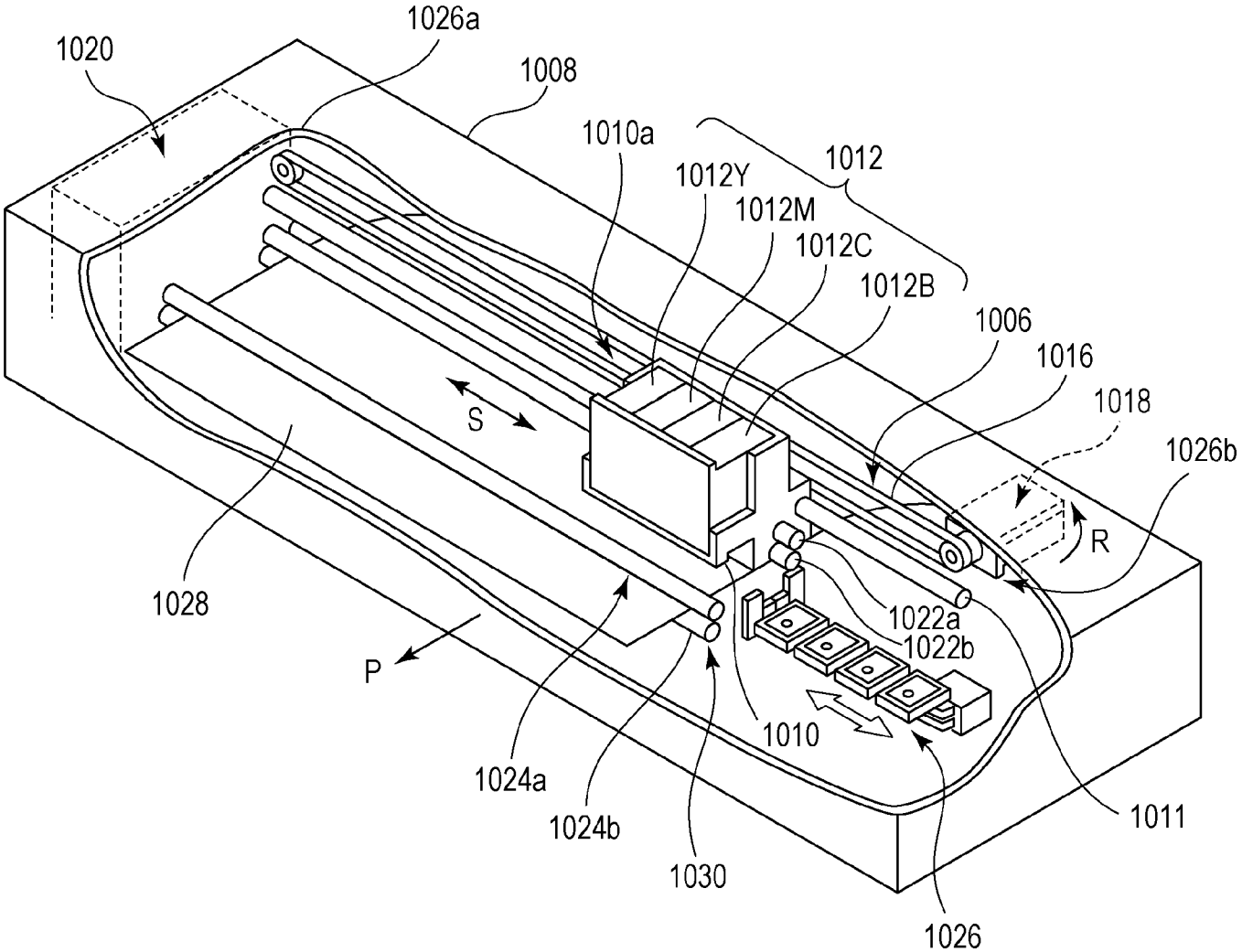
FIG. 4 is a perspective view illustrating an inkjet printer on which an inkjet head according to an embodiment of the present invention is mounted.

FIG. 4 is a schematic perspective view illustrating an exemplary inkjet printer as a liquid ejecting apparatus according to the present embodiment.

The inkjet printer includes a conveying device 1030 which intermittently conveys a paper sheet 1028 as a recording medium in the direction of arrow P in a casing 1008. The inkjet printer also includes a recording unit 1010 and a movement driving unit 1006. The recording unit 1010 reciprocates in the direction S which crosses perpendicularly the conveyance direction P of the paper sheet 1028, and includes the inkjet head 1. The movement driving unit 1006 is provided as a driving unit which makes the recording unit 1010 reciprocate.

The conveying device 1030 includes a pair of roller units 1022*a* and 1022*b*, a pair of roller units 1024*a* and 1024*b*, and a driving unit 1020 which drives these roller units. These pairs of roller units are disposed in parallel with each other and facing each other. When the driving unit 1020 is started, the paper sheet 1028 is held between the roller units 1022*a* and 1022*b* and between the roller units 1024*a* and 1024*b* and is conveyed intermittently in the direction P.

The movement driving unit 1006 includes a belt 1016 and a motor 1018. The belt 1016 is wound around pulleys 1026*a* and 1026*b* which are disposed in parallel with each other and facing each other at predetermined intervals with respect to a rotation shaft, and is disposed in parallel with the roller units 1022*a* and 1022*b*. The motor 1018 drives, forward and backward, the belt 1016 which is connected to a carriage member 1010*a* of the recording unit 1010.

When the motor 1018 is started and the belt 1016 is rotated in the direction of arrow R, the carriage member 1010*a* is moved in the direction of arrow S by a predetermined moving distance. When the belt 1016 is rotated in the opposite direction to the direction of arrow R, the carriage member 1010*a* is moved in the direction opposite to the direction of arrow S by a predetermined moving distance. A reproduction unit 1026 is provided at a position which is a home position of the carriage member 1010*a* to face an ink ejection surface of the recording unit 1010. The reproduction unit 1026 performs an ejection reproduction process of the recording unit 1010.

The recording unit 1010 includes cartridges 1012 which are detachably attached to the carriage member 1010*a*. The cartridges are provided for each color; for example, a yellow cartridge 1012Y, a magenta cartridge 1012M, a cyan cartridge 1012C and a black cartridge 1012B are provided.

First Embodiment

Figure 5:
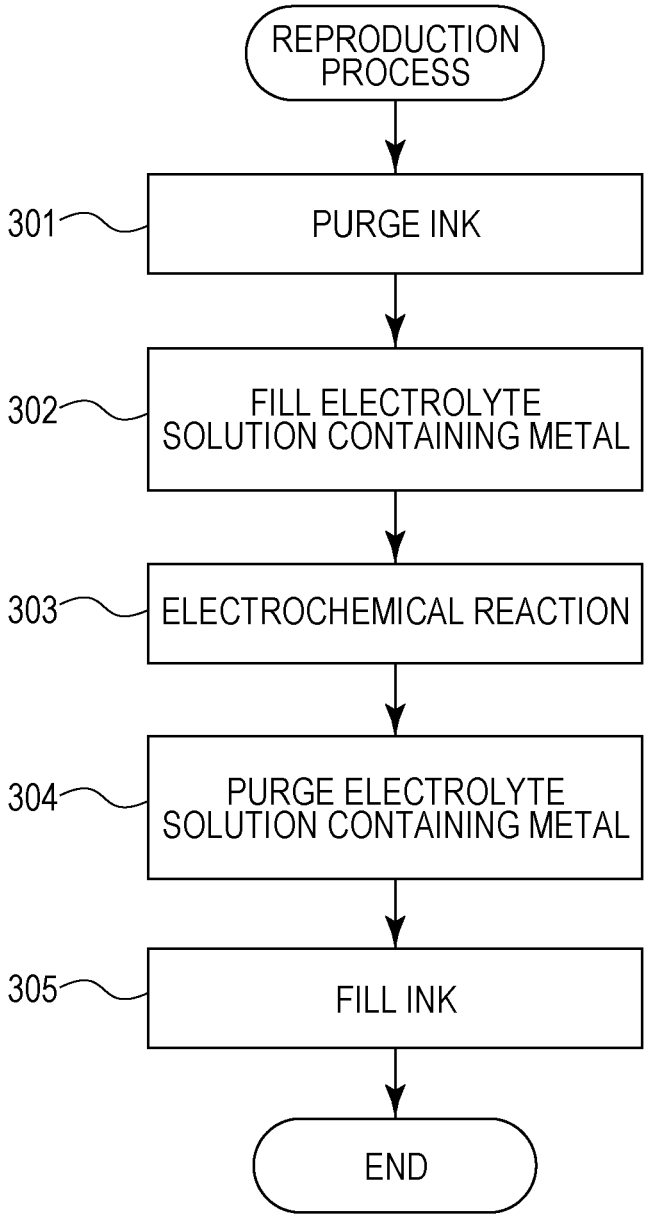
FIG. 5 is a flowchart illustrating a reproduction procedure of an inkjet head according to a first embodiment.

A reproduction method of the upper protective layer 107*a* according to the first embodiment of the thus-configured inkjet head 1 will be described. The present embodiment is to reproduce the upper protective layer 107*a* by plating the inkjet head 1 which has been used for a predetermined period. FIG. 5 is a flowchart illustrating a reproduction procedure of the inkjet head 1 of the present embodiment.

Figure 6A:
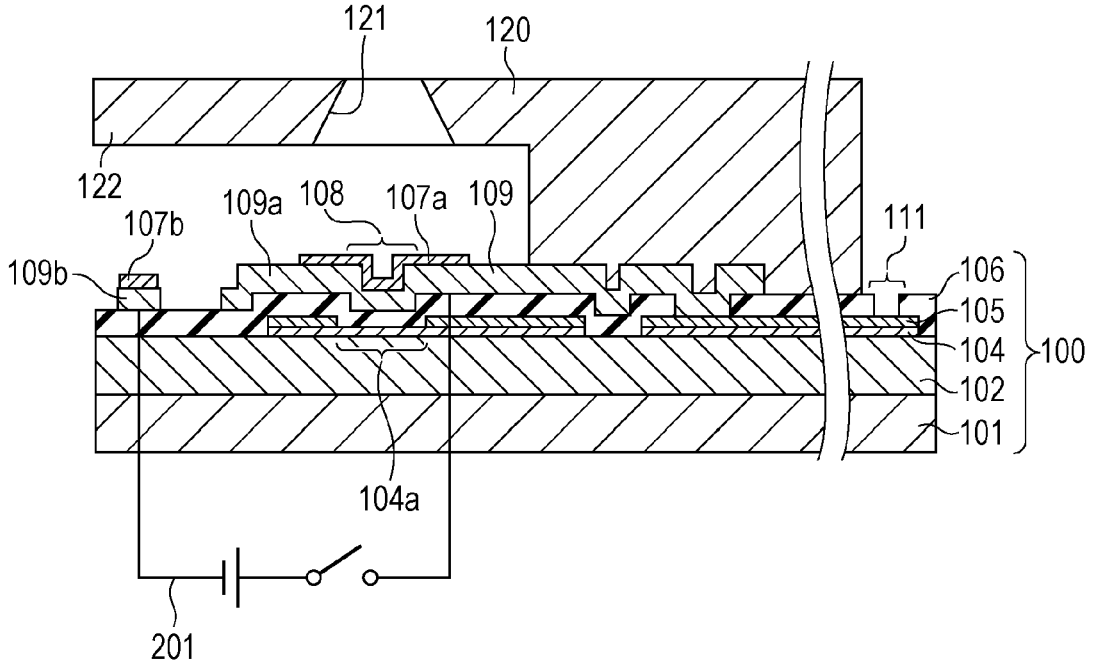
FIG. 6A is a schematic cross-sectional view illustrating a reproduction process of an inkjet head according to the first embodiment.

First, in step 301, ink is purged from the inkjet head 1. By purging the ink in advance, replacement with an electrolyte solution containing metal supplied in a subsequent step may be performed efficiently. Further, by purging the ink and storing somewhere else, since the ink is not mixed to the electrolyte solution containing metal, the ink may be reused. The state after step 301 is completed is illustrated in FIG. 6A.

Next, in step 302, an electrolyte solution containing metal 200 (a plating solution) is supplied to the inkjet head 1. With this process, the electrode 107*b* provided in the flow path and the upper protective layer 107*a* become conductive via the electrolyte solution 200.

Figure 6B:
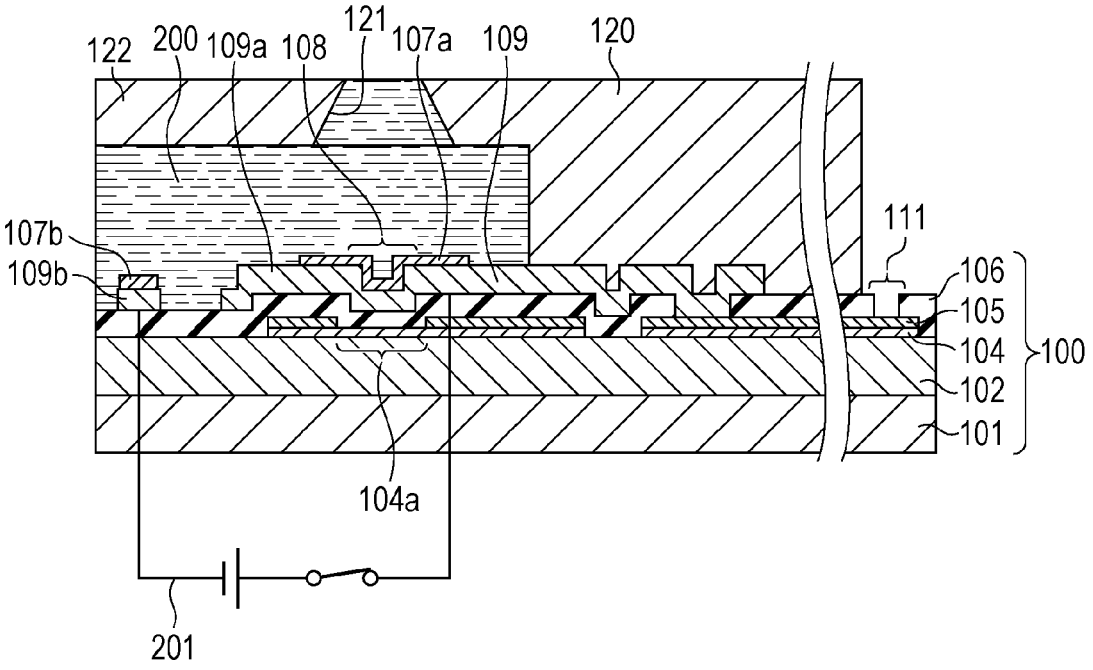
FIG. 6B is a schematic cross-sectional view illustrating a reproduction process of an inkjet head according to the first embodiment.

Next, in step 303, a potential difference is produced between the upper protective layer 107*a*, which is used as a cathode, and the electrode 107*b*, which is used as an anode, by, for example, a voltage applying unit 201 provided in an inkjet printer main body so that a current flows through the electrolyte solution containing metal 200. With this process, the metal contained in the electrolyte solution 200 deposits on the upper protective layer 107*a*. The state of step 303 is illustrated in FIG. 6B. Although the voltage applying unit 201 is illustrated schematically, the voltage is actually applied via the electrode terminals 111 which are connected separately to the upper protective layer 107*a* and to the electrode 107*b*.

Next, in step 304, the electrolyte solution containing metal 200 is purged from the inkjet head 1. In this manner, replacement with ink in the subsequent process may be performed efficiently.

Finally, in step 305, the inkjet head 1 is supplied with ink and then the inkjet head 1 is placed in a state in which ejection of the ink may be performed again.

Examples 1 to 4

Examples 1 to 4 to which the first embodiment was applied were evaluated.

In each of Examples 1 to 4, the upper protective layer 107*a* of about 50 nm was formed using the material shown in Table 1. The inkjet head 1 was filled with the ink BCI-7eC (manufactured by CANON KABUSHIKI KAISHA; pH: about 9). A voltage of 20 V and a driving pulse of 1.5 μs in width were applied $5.0\times10^8$ times at a frequency of 5 kHz to the heating portion 104*a*. Then, an ejection evaluation test was performed. In each Example, it was demonstrated that the thickness of the upper protective layer 107*a* was reduced. It was also demonstrated that, when recording was performed using the inkjet head 1 of this state, the ink did not land at desired positions and that recording quality was lowered. Table 1 also shows the reduced amount of the thickness reduced during the evaluation test.

Next, a reproduction process of the upper protective layer 107*a* of each Example was performed by the reproduction method of the inkjet head 1 according to the first embodiment illustrated in FIG. 5. The inkjet head 1 was filled with an electrolyte solution containing metal which forms the upper protective layer 107*a* of each Example illustrated in Table 1 and a DC voltage was applied using the upper protective layer 107*a* as a cathode and the electrode 107*b* as an anode. Table 1 also shows current density and voltage application time of the current which flows between the upper protective layer 107*a* and the electrode 107*b* at that time.

Then, the electrolyte solution used for the reproduction process was purged from the inkjet head 1, the inkjet head 1 was filled with ink again, and recording was performed using the inkjet head 1 of each Example. It was demonstrated that the ink landed at desired positions.

TABLE 1

| | METALLIC MATERIAL CONTAINED IN UPPER PROTECTIVE LAYER AND ELECTROLYTE SOLUTION | REDUCTION AMOUNT IN THICKNESS OF UPPER PROTECTIVE LAYER (nm) | CURRENT DENSITY ($mA/dm^2$) | VOLTAGE APPLICATION TIME (s) |
|---|---|---|---|---|
| EXAMPLE 1 | Ir | 25 | 4.0 | 10 |
| EXAMPLE 2 | Ru | 30 | 10.0 | 18 |
| EXAMPLE 3 | Pd | 27 | 7.5 | 30 |
| EXAMPLE 4 | Pt | 25 | 10.0 | 30 |

Second Embodiment

Figure 7:
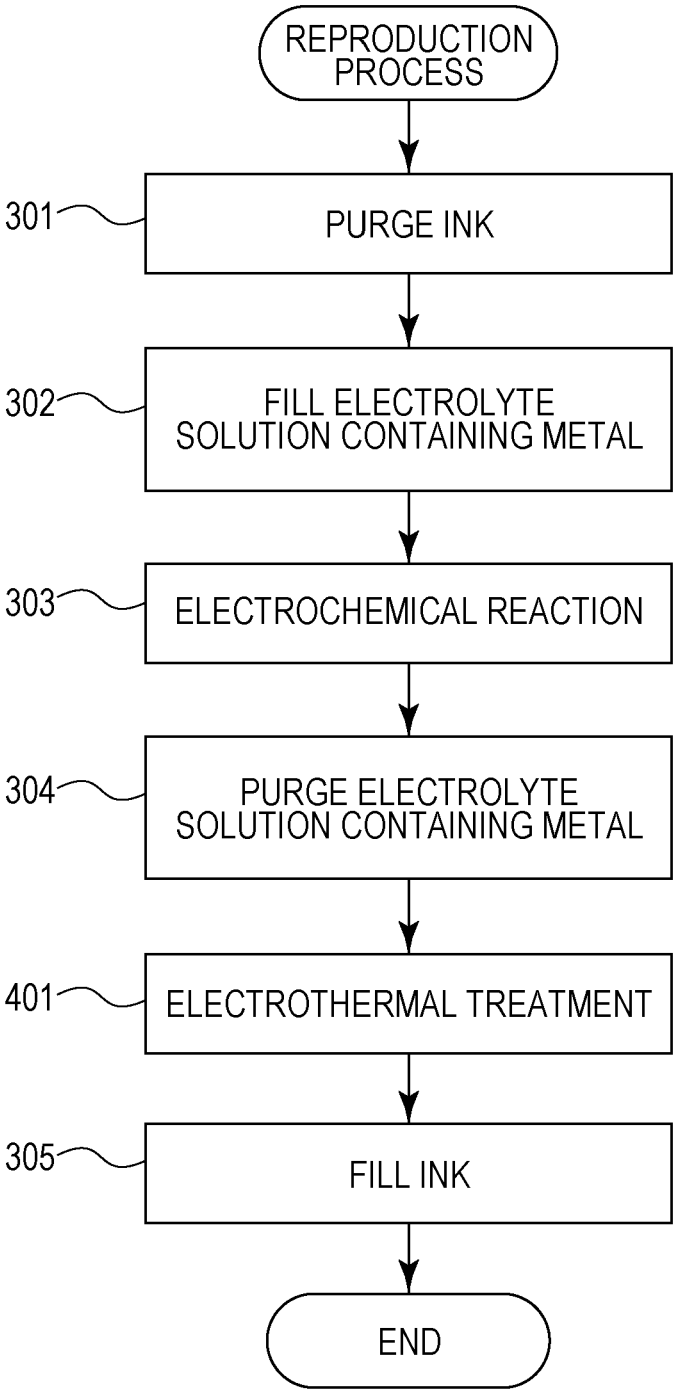
FIG. 7 is a flowchart illustrating a reproduction procedure of the inkjet head according to a second embodiment.

In the present embodiment, in addition to the first embodiment, a heat treatment process is performed after the reproduction process. FIG. 7 is a flowchart illustrating a reproduction procedure of the inkjet head 1 according to the present embodiment.

After the upper protective layer 107*a* is reproduced and the electrolyte solution containing metal is purged from the inkjet head 1, power is supplied to the heating resistor layer 104 to make the heating portion 104*a* generate heat for a predetermined time period in step 401. Such a heat treatment desirably improves film quality of the reproduced upper protective layer 107*a* and desirably increases the number of times of ejection events.

Examples 5 to 7

Examples 5 to 7 to which the second embodiment was applied were evaluated.

In these Examples, the upper protective layer 107*a* was made of Ir as in Example 1. The ejection evaluation test, current density and voltage application time during the reproduction process were also the same as those of Example 1.

Then, in Examples 5 to 7, a heat treatment was performed in the following manner: power was supplied to the heating resistor layer 104 so that the temperatures of the heating portion 104*a* as shown in Table 2 were obtained and kept for 30 minutes.

After the heat treatment process, the inkjet head 1 was filled with ink again and recording was performed. There was a correlation between the number of times of ejection events until reduction in recording quality was recognized and the heat treatment temperature. Table 2 shows the correlation between the heat treatment temperature and the number of times of ejection events until reduction in recording quality was recognized.

TABLE 2

| | HEAT TREATMENT TEMPERATURE (° C.) | NUMBER OF TIMES OF EJECTION EVENTS |
|---|---|---|
| EXAMPLE 5 | 200 | $7.0 \times 10^8$ |
| EXAMPLE 6 | 300 | $1.0 \times 10^9$ |
| EXAMPLE 7 | 400 | $2.0 \times 10^9$ |

As described above, it has been demonstrated that the number of times of ejection events until reduction in recording quality is recognized increases as the heat treatment temperature rises. This is considered to be because the heat treatment increases crystallinity of the upper protective layer 107*a*. If the heat treatment temperature is set to be higher than 400 degrees C., there is a possibility that the electrode wiring layer 105 made of Al, Al—Si, Al—Cu and the like may be adversely affected. Therefore, the temperature during the heat treatment is desirably not lower than 200 degrees C. to not higher than 400 degrees C.

Third Embodiment

In the embodiments described above, the upper protective layer 107*a* is reproduced using the electrode 107*b* provided in the flow path of the inkjet head 1. In the present embodiment, the upper protective layer 107*a* is reproduced using an electrode which is provided outside the inkjet head 1.

Figure 8:
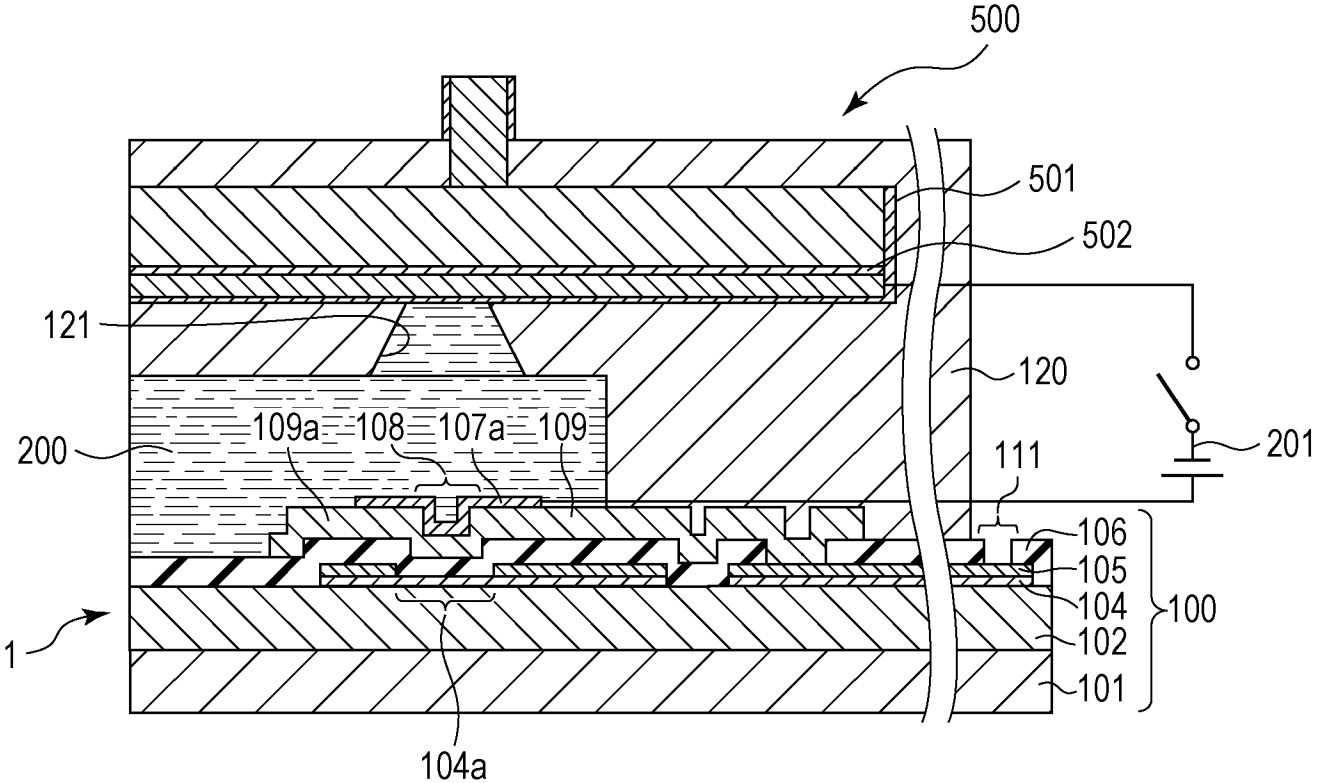
FIG. 8 is a schematic plan view for describing an inkjet head and a reproduction process of the inkjet head according to a third embodiment.
Figure 9:
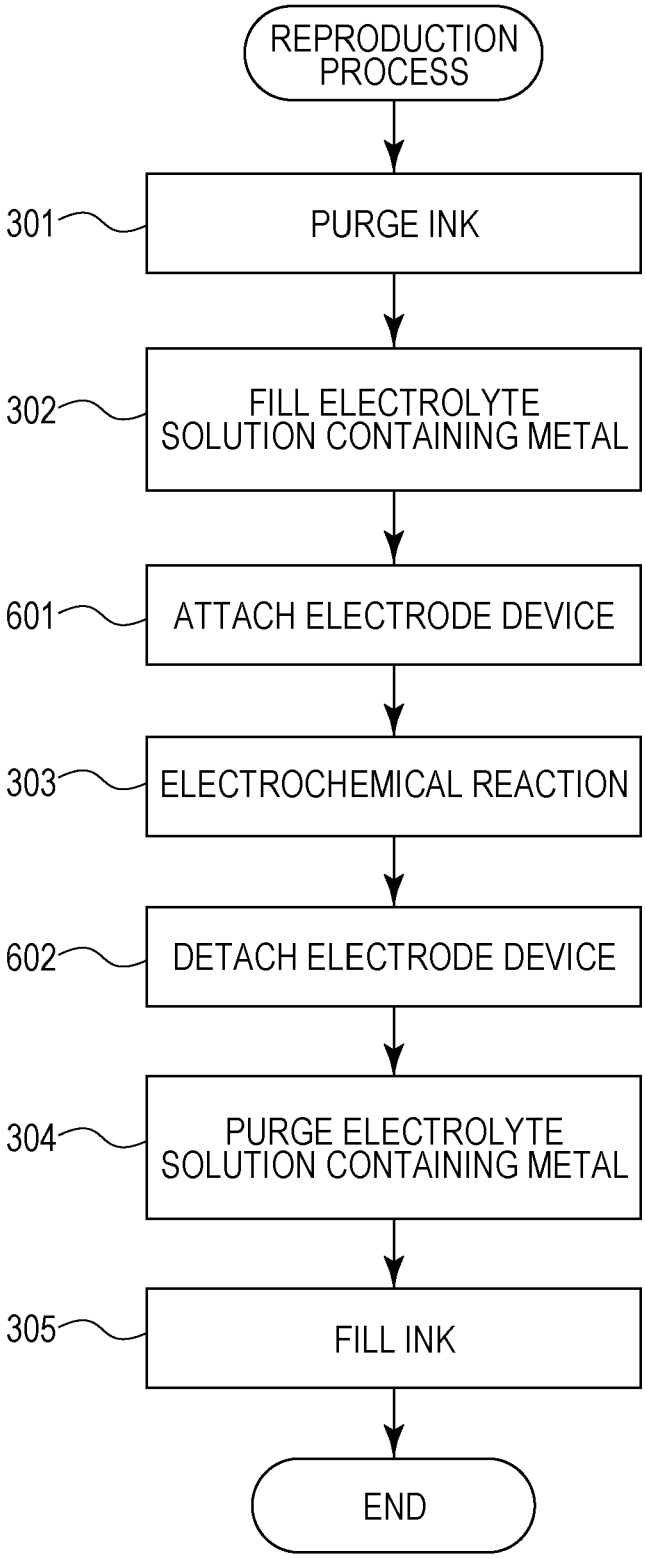
FIG. 9 is a flowchart illustrating a reproduction procedure of the inkjet head according to the third embodiment.

FIG. 8 is a diagram for describing the inkjet head 1 according to the present embodiment and a reproduction process thereof. FIG. 9 is a flowchart illustrating a reproduction procedure of the inkjet head 1 according to the present embodiment.

As illustrated in FIG. 8, in the present embodiment, an electrode 502 in an electrode device 500 provided in an inkjet printer main body on which the inkjet head 1 is mounted is used. The electrode device 500 includes a cap 501 which covers ejection ports 121 of the inkjet head 1. A porous electrode 502 is provided inside the cap 501.

In step 601 of FIG. 9, the electrode device 500 is attached to the inkjet head 1 so that the electrode 502 is in parallel with and facing a surface of the upper protective layer 107*a*. Then a voltage is applied to between the upper protective layer 107*a* and the electrode 502 by the voltage applying unit 201 to perform a reproducing process of the upper protective layer 107*a*. Then, the electrode device 500 is detached from the inkjet head 1 in step 602.

In the case in which the present embodiment was applied, the upper protective layer 107*a* was also made of Ir as in Example 1. The effect was evaluated while the conditions such as the ejection evaluation test, current density and voltage application time during the reproduction process were also the same as those of Example 1. After the reproduction process of the upper protective layer 107*a*, it was demonstrated that the ink had landed at desired positions, and that recording quality lowered by the ejection evaluation test was improved.

According to the present invention, by reproducing the upper protective layer, it is possible to perform high quality recording for a prolonged period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-093094, filed Apr. 25, 2013 which is hereby incorporated by reference herein in its entirety.

What is claimed is:

1. A reproduction method of a liquid ejecting head, the method comprising:

a process of providing a liquid ejection head substrate including a thermal energy generating element configured to generate thermal energy for the ejection of a liquid, an insulating protective layer configured to cover the thermal energy generating element, and an upper protective film provided in the insulating protective layer at a position corresponding to the thermal energy generating element and including a surface in contact with the liquid, and a flow path member comprising a wall is configured to form, between itself and the liquid ejection head substrate, a flow path through which the liquid to be ejected is supplied on the surface of the upper protective film;

a process of filling the flow path with an electrolyte solution containing metal, and filling a space between an electrode and the upper protective film with the electrolyte solution;

a process of applying a voltage between the upper protective film and the electrode to make the metal contained in the electrolyte solution deposit on the surface of the upper protective film;

a process of purging the liquid from the flow path before the process of filling the flow path with the electrolyte solution, the liquid being ejected by supplying power to the thermal energy generating element;

a process of filling the flow path with the liquid after the process of making the metal deposit; and a process of performing a heat treatment on the upper protective film by supplying power to the thermal energy generating element before the process of filling the flow path with the liquid and after the process of making the metal deposit.

2. The reproduction method of a liquid ejecting head according to claim 1, further comprising a process of purging the electrolyte solution from the flow path.

3. The reproduction method of a liquid ejecting head according to claim 1, wherein the temperature of the thermal energy generating element is set to be not lower than 200 degrees C. to not higher than 400 degrees C. in the process of performing the heat treatment.

4. The reproduction method of a liquid ejecting head according to claim 1, wherein the electrode is provided in the flow path.

5. The reproduction method of a liquid ejecting head according to claim 1, wherein the electrode is provided in a liquid ejecting apparatus on which the liquid ejecting head is mounted.

6. The reproduction method of a liquid ejecting head according to claim 1, wherein the upper protective film is made of a material which includes at least one of Ir, Ru, Pd and Pt.

7. The reproduction method of a liquid ejecting heat according to claim 1, wherein the metal contained in the electrolyte solution is the same material as metal forming the upper protective film.

8. The reproduction method of a liquid ejecting head according to claim 1, further comprising:

a process of purging the electrolyte solution from the flow path before the process of performing the heat treatment.

* * * * *